US009391364B2

(12) United States Patent
Ikonen et al.

(10) Patent No.: US 9,391,364 B2
(45) Date of Patent: Jul. 12, 2016

(54) MOBILE COMMUNICATION DEVICE WITH IMPROVED ANTENNA PERFORMANCE

(75) Inventors: Pekka Ikonen, Espoo (FI); Juha Ellä, Halikko (FI)

(73) Assignee: EPCOS AG, Munich (DE)

( * ) Notice: Subject to any disclaimer, the term of this patent is extended or adjusted under 35 U.S.C. 154(b) by 556 days.

(21) Appl. No.: 13/885,671

(22) PCT Filed: Nov. 25, 2010

(86) PCT No.: PCT/EP2010/068225

§ 371 (c)(1),
(2), (4) Date: Aug. 1, 2013

(87) PCT Pub. No.: WO2012/069086

PCT Pub. Date: May 31, 2012

(65) Prior Publication Data

US 2014/0009360 A1 Jan. 9, 2014

(51) Int. Cl.

| | |
|---|---|
| ***H01Q 1/24*** | (2006.01) |
| ***H01Q 1/50*** | (2006.01) |
| ***H01Q 1/52*** | (2006.01) |

(52) U.S. Cl.

CPC ..... *H01Q 1/50* (2013.01); *H01Q 1/242* (2013.01); *H01Q 1/521* (2013.01)

(58) Field of Classification Search

CPC ..... H01Q 1/242; H01Q 1/50; H01Q 1/521
USPC ..... 343/700 MS, 702, 850, 852, 853, 876, 343/725

See application file for complete search history.

(56) References Cited

U.S. PATENT DOCUMENTS

| | | | | |
|---|---|---|---|---|
| 4,924,237 | A * | 5/1990 | Honda | H01Q 1/243 343/702 |
| 5,784,032 | A * | 7/1998 | Johnston | H01Q 1/243 343/702 |
| 6,731,920 | B1 | 5/2004 | Iwai et al. | |
| 6,985,113 | B2 | 1/2006 | Nishimura et al. | |
| 7,116,271 | B2 | 10/2006 | Kostanic et al. | |
| 7,162,284 | B2 | 1/2007 | Kobayashi et al. | |
| 7,180,464 | B2 * | 2/2007 | Chiang | H01Q 1/242 343/702 |
| 7,505,001 | B2 * | 3/2009 | Deavours | G06K 19/07749 340/572.7 |
| 7,505,006 | B2 | 3/2009 | Ollikainen et al. | |
| 7,528,783 | B2 | 5/2009 | Takagi | |

(Continued)

FOREIGN PATENT DOCUMENTS

| | | | |
|---|---|---|---|
| DE | 10 2009 004 720 | A1 | 7/2010 |
| DE | 10201001411 | A1 | 9/2011 |

(Continued)

*Primary Examiner* — Tho G Phan

(74) *Attorney, Agent, or Firm* — McDermott Will & Emery LLP

(57) ABSTRACT

The present invention concerns a mobile communication device comprising a ground plane, a main antenna comprising a main radiator (MRAD) that can couple electromagnetically to the ground plane and to a first signal path (SPm), a diversity antenna comprising a diversity radiator (DRAD), a reconfigurable input matching circuit that couples the diversity radiator (DRAD) to the ground plane and to a second signal path (SPd), and a control unit (CU) coupled to the reconfigurable input matching circuit and adapted to change the coupling of the diversity radiator (DRAD) to the ground plane during operation. The present invention further concerns to a method to enhance the performance of the device.

15 Claims, 3 Drawing Sheets

(56) References Cited

U.S. PATENT DOCUMENTS

| | | | | |
|---|---|---|---|---|
| 7,724,194 | B2 | 5/2010 | Black et al. | |
| 7,750,866 | B2 * | 7/2010 | Rambeau | H01Q 7/00 343/793 |
| 7,786,819 | B2 | 8/2010 | Ella et al. | |
| 7,825,861 | B2 | 11/2010 | Sato et al. | |
| 2004/0263411 | A1 | 12/2004 | Fabrega-Sanchez et al. | |
| 2005/0099343 | A1 * | 5/2005 | Asrani | H01Q 1/084 343/702 |
| 2006/0214857 | A1 * | 9/2006 | Ollikainen | H01Q 1/243 343/702 |
| 2009/0096683 | A1 | 4/2009 | Rosenblatt et al. | |
| 2010/0157858 | A1 | 6/2010 | Lee et al. | |
| 2010/0220017 | A1 | 9/2010 | Ollikainen et al. | |

FOREIGN PATENT DOCUMENTS

| | | | |
|---|---|---|---|
| JP | 2004179995 | A | 6/2004 |
| JP | 2008085869 | A | 4/2008 |
| KR | 20090060310 | | 6/2009 |
| WO | 03/103087 | A2 | 12/2003 |
| WO | WO-2010032066 | A1 | 3/2010 |
| WO | 2010/052150 | A1 | 5/2010 |
| WO | 2011/134492 | A1 | 11/2011 |

* cited by examiner

MOBILE COMMUNICATION DEVICE WITH IMPROVED ANTENNA PERFORMANCE

The present invention relates to a mobile communication device offering improved antenna performance and to a method to enhance the performance of a mobile communication device.

Modern mobile communication devices need to be small and lightweight but have to support multiple frequency bands and multiple communication standards, such as GSM (Global System for Mobile Communication), (W)CDMA ((Wideband) Code Division Multiple Access), or LTE (Long-Term Evolution). LTE, a communication standard of the fourth generation, 4G, inherently requires two antennas to operate simultaneously. Multi-antenna transmission modes in LTE systems can improve the service capabilities of a communication device. Therefore, a mobile communication device can comprise a main antenna and a diversity antenna.

However, current demands towards smaller communication devices inhibit designers of modern communication devices to include additional antenna components within modern communication devices although communication devices with improved antenna performance are needed. An improved antenna performance e.g. helps to save battery power.

From U.S. Pat. No. 7,505,006 B2, an antenna arrangement comprising a coupling antenna element and an extension element is known. An antenna element has a first resonant frequency and a first bandwidth and the extended conductive element has a second resonant frequency and a second bandwidth. Thus, an antenna arrangement is provided that can cover a broad range of frequencies.

PCT/EP2009/064094 describes a mobile communication device comprising at least two antennas. At a given time, an inactive antenna can be terminated by the front-end circuit to reduce detrimental interaction between the active and the inactive antennas. Thus, the inactive antenna becomes electrically invisible to the active antenna.

It is an object of the present invention to provide a mobile communication device that supports multiple frequency bands and multiple communication standards, that allows to be integrated into a small housing, and that has a better antenna performance.

A mobile communication device according to claim 1 and a method to enhance the performance of the device according to claim 13 provide solutions for these objects. The dependent claims disclose advantageous embodiments of the present invention.

The present invention provides a mobile communication device comprising a ground plane, a main antenna comprising a main radiator that can couple electromagnetically to the ground plane and to the first signal path, a diversity antenna comprising a diversity radiator and a reconfigurable input matching circuit that couples the diversity radiator to the ground plane and to a second signal path. Further, a control unit is coupled to the reconfigurable input matching circuit and adapted to change the coupling of the diversity radiator to the ground plane during operation of the device.

The term "radiator" refers to a radiating element. The term "antenna" sums up all elements of an antenna assembly, e.g. the radiator and the ground plane against which it is excited. The communication device comprises a main antenna wherein the main antenna comprises the main radiator. Further, the communication device comprises a diversity antenna wherein the diversity antenna comprises the diversity radiator.

Especially at low-band frequencies close to 900 MHz, it is challenging to achieve an instantaneous wide band impedance matching. The term "impedance bandwidth" refers to the range of frequencies over which a radiator can adequately be matched to the system impedance, typically to 50Ω. Narrow impedance bandwidth maps into challenges for obtaining high total efficiency at low-band edges. At frequencies close to 1000 MHz, the printed wiring board (PWB) contributes significantly to radiation and impedance bandwidth. The first resonance of a PWB with typical handset dimensions is approximately at 1100-1200 MHz. Thus, below 1000 MHz, typical PWB is inherently electrically too short to be in resonance and therefore does not contribute optimally to achieving the widest impedance bandwidth. Therefore, the present invention provides a technique to electrically lengthen the PWB. This maximizes the low-band impedance bandwidth and the total efficiency at band edges.

The control unit can couple the diversity radiator in one mode mainly to the ground plane. In this mode, the diversity radiator is utilized as a PWB extension. The control unit can reconfigure the input matching circuit to set a certain coupling which provides an adapted impedance of the diversity radiator to electrically lengthen the PWB to the resonant frequency of the corresponding communication channel. Instead of a simple switch that couples the diversity radiator either only to the ground plane or only to the signal path, a matching circuit is used. The use of the matching circuit provides more degrees of freedom to adjust the coupling of the diversity radiator to the ground plane during operation.

A configuration of the reconfigurable input matching circuit which properly terminates an inactive diversity radiator and which is implemented in the proposed way noticeably widens the impedance bandwidth of the active used antenna and thus improves the total efficiency at band edges.

A diversity radiator is required by a communication device for multi-antenna transmission modes anyway and is, hence, already present in the device. Electromagnetically coupling the ground plane to the diversity radiator, however, yields a better antenna performance of the main antenna without the need to add further radiating elements to the communication device.

In a mobile communication device according to the present invention, the main radiator, the ground plane and the diversity radiator work together and act as a radiating element that has a better performance compared to an antenna assembly comprising only the main radiator and the ground plane.

In practice, the diversity radiator becomes a radiating part of the ground plane and is increasing the electrical length of the ground plane.

Coupling a diversity radiator electromagnetically to a ground plane, e.g. during a communication standard that does not require multi-antenna transmission modes, is not a triviality: one aspect in gaining a lightweight mobile communication device is reducing the weight of the device's battery. Then, however, the power consumption of the mobile communication device has to be reduced to allow sufficient time of operation. The most important step in reducing the power consumption of the mobile communication device is to deactivate every component that is not needed during a current operation mode. In multi-antenna transmission modes, the diversity receiver, and therefore also the diversity radiator, cannot be deactivated. For example, in GSM communication mode, the diversity radiator is not used for communication and is usually inactive together with all diversity reception-related electronics. In WCDMA, the usage of diversity antennas is optional; here, it could also be inactive or used for other purposes. It is clear that the diversity antenna and its related electronics would be deactivated in WCDMA mode when saving battery power is important.

However, battery power consumption can also be reduced if the antenna performance is enhanced. This is because less power has to be drawn from the power amplifier with better antenna input matching.

Thus, it is possible to reduce the power consumption of a mobile communication device by keeping a diversity radiator active although it is not used for multi-antenna transmission modes.

As the main radiator, the ground plane and the diversity radiator act as a radiating element, it is clear that the ground plane cannot be regarded as being on a strict ground potential. The ground plane may be electrically connected to a ground connection but the electromagnetic potential of the ground plane may not be the electromagnetic potential of a conventional ground.

In one embodiment, the reconfigurable input matching circuit comprises a tunable capacitor. The diversity radiator can be connected to the ground plane via a path that comprises the tunable capacitor. When the capacitance of the tunable capacitor is set to a maximum value, the reactance and the resistance of the capacitor is rather low. Accordingly, the diversity radiator is coupled mainly to ground via a very low-ohmic path. This setting is preferably chosen when the diversity radiator is inactive.

However, the capacitance of the tunable capacitor can be set to a value below a maximum value when the diversity antenna is active. If the capacitance is set to a rather small value, the path comprising the tunable capacitor will be similar to an open connection. Accordingly, the diversity radiator does not interact with the capacitor and a signal received by the radiator does not flow to the ground through the capacitor.

The reconfigurable input matching circuit can further comprise a second tunable capacitor and a sensing coil. Furthermore, the reconfigurable input matching circuit can comprise any number of tunable capacitors andb sensing coils.

Further, to get maximum benefit from the diversity radiator operating as ground-plane extension, the diversity radiator should be located as far as possible from the main radiator. It is, therefore, possible to locate the diversity radiator and the main radiator at opposite ends or sides of an according mobile communication device to get an optimal performance.

The geometrical dimensions of the ground plane are important to obtain a good antenna characteristic, too. Further, the control unit and the reconfigurable input matching circuit can be arranged on the PWB, too.

In one embodiment, coupling the diversity radiator to the ground plane enhances the performance of the main antenna in a GSM operation mode, in a WCDMA operation mode, or in an LTE TDD (TDD=Time Division Duplexing) operation mode.

An LTE TDD operation mode can also benefit from a diversity radiator coupled to the ground plane. The diversity antenna—which may be an MIMO antenna (MIMO=Multiple-Input and Multiple-Output)—could be used to improve the main antenna performance during the TX slot and used as MIMO or a diversity antenna during the RX slot. LTE TDD is similar to GSM in that aspect that is has time divided TX and RX slots.

In principle, it is possible to enhance the performance of the main antenna in any operation mode that does not necessarily need active diversity receiver and corresponding radiator.

In one embodiment, the mobile communication device comprises two or more main antennas. Further, the mobile communication device can comprise two or more diversity antennas, wherein each diversity antenna is connected to a reconfigurable input matching circuit that couples the respective diversity radiator to the ground plane and to a diversity signal path. In this case, the control unit can change the coupling of each diversity radiator individually to the ground plane during operation of the device.

Moreover, the present invention discloses a method for enhancing the performance of a mobile communication device. The mobile communication device comprises a ground plane, a main antenna comprising a main radiator that can couple electromagnetically to the ground plane and to a first signal path, a diversity antenna comprising a diversity radiator and a reconfigurable input matching circuit that couples the diversity radiator to the ground plane and to a second signal path. The mobile communication device further comprises a control unit coupled to the reconfigurable input matching circuit and adapted to change the coupling of the diversity radiator to the ground plane during operation. In one embodiment, the control unit reconfigures the reconfigurable input matching circuit during operation of the device to change the coupling of the diversity radiator to the ground plane and to enhance the performance of the main antenna.

Further, during operation of the main antenna with an inactive diversity antenna, the control unit can reconfigure the reconfigurable input matching circuit to provide a coupling of the diversity radiator to the ground plane that is lower ohmic compared to the coupling of the diversity radiator to the second signal path. During simultaneous operation of the main antenna and the diversity antenna, the control unit reconfigures the reconfigurable input matching circuit to provide a coupling of the diversity radiator to the ground plane that is higher-ohmic compared to the coupling of the diversity radiator to the second signal path.

Further, the reconfigurable input matching circuit can comprise a tunable capacitor, wherein the diversity radiator is connected to the ground plane via a path that comprises the tunable capacitor. The control unit can set the capacitance of the tunable capacitor to a maximum value when the diversity radiator is inactive and to a value below a maximum value when the diversity radiator is active.

The present invention will become fully understood from the detailed description given hereinbelow and the accompanying schematic drawings. In the drawings.

Figure 1:
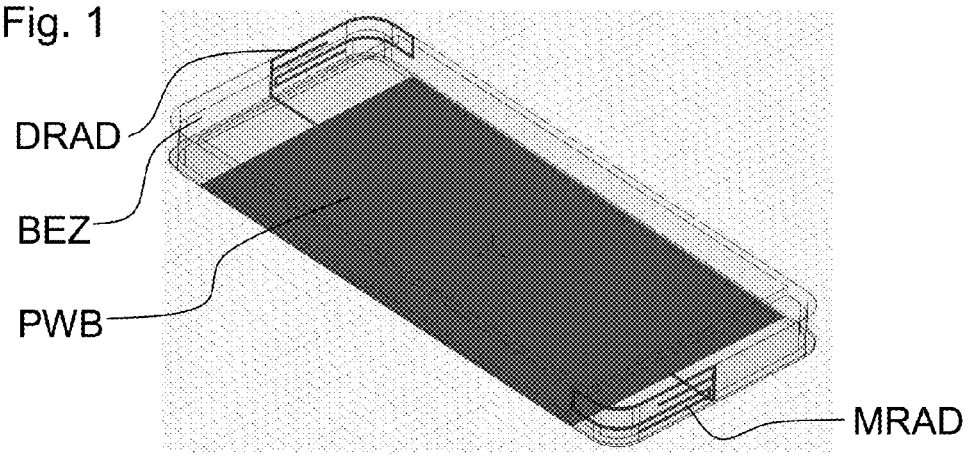
FIG. 1 shows an example radiator configuration comprising a main and a diversity radiator.

FIG. 1 shows a mobile communication device. The device comprises a main radiator MRAD and a diversity radiator DRAD. Further, the device comprises a printed wiring board PWB and a plastic bezel BEZ having typical dimensions of a currently used handset. The plastic bezel BEZ is a supporting part placed on top of the PWB. On top of the plastic bezel BEZ, the radiators MRAD, DRAD are printed or implemented with flex-film. Accordingly, the bezel BEZ is a housing for the radiators MRAD, DRAD and for other mechanical parts of the device which are not shown in FIG. 1.

In the device as shown in FIG. 1, the two radiators MRAD, DRAD are dual-branch monopoles implemented using flex-film assembly in the plastic bezel BEZ. The radiators MRAD, DRAD are positioned at the bottom and at the top of the PWB. In principle, the relative positioning of the radiators MRAD, DRAD can be arbitrary. However, the biggest impact on the active radiator low-band impedance bandwidth is achieved when the radiators MRAD, DRAD are located at opposite ends of the PWB. At higher frequencies, e.g. frequencies over 2000 MHz, also higher order PWB resonances start to occur. Thus, at some frequencies, also other relative radiator positions can lead to bandwidth improvement.

Figure 2A:
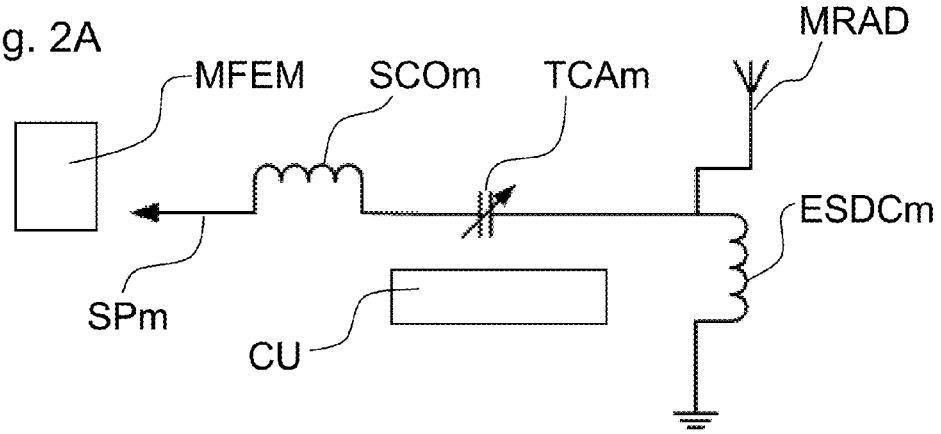
FIG. 2A shows reconfigurable input matching circuits connected to a main antenna.
Figure 2B:
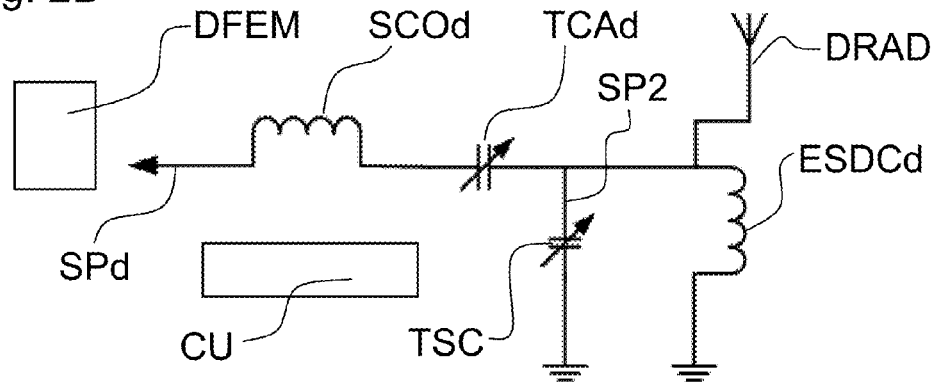
FIG. 2B shows reconfigurable input matching circuits connected to a diversity antenna.

FIG. 2A and FIG. 2B show schematically reconfigurable input matching circuits. FIG. 2A shows a reconfigurable input matching circuit that is connected to a main radiator MRAD. FIG. 2B shows a reconfigurable input matching circuit that is connected to a diversity radiator DRAD.

The reconfigurable matching circuit, connected to the main radiator MRAD, comprises a main sensing coil SCOm and a tunable capacitor TCAm. The main radiator MRAD is coupled to a main signal path SPm. The tunable capacitor TCAm and the sensing coil SCOm are in series in the main signal path SPm. Therefore, the tunable capacitor TCAm is referred to as tunable main series capacitor TCAm in the following.

The main signal path SPm is connected to a main front-end module MFEM. Further, the main signal path SPm is connected to ground via an ESD coil ESDCm. The ESD coil ESDCm protects the tunable capacitor TCAm and the main front-end module MFEM against electro-static discharge.

The capacitance of the tunable main series capacitor TCAm can be set by a control unit CU to various values. Thereby, the control unit CU can adapt the coupling of the main radiator MRAD to the signal path SPm and to the main front-end module MFEM. The control unit CU is indicated in FIG. 2A and FIG. 2B.

FIG. 2B shows a reconfigurable input matching circuit connected to a diversity radiator DRAD. The diversity radiator DRAD is electrically coupled to a diversity signal path SPd. The diversity signal path SPd is connected to a diversity front-end module DFEM. Further, the diversity signal path SPd is connected to ground via an ESD coil ESDCd.

The reconfigurable input matching circuit also comprises a tunable diversity series capacitor TCAd and a diversity sensing coil SCOd in series in the diversity signal path SPd. In addition, the diversity signal path SPd is connected to ground via a second path SP2 which comprises a tunable shunt capacitor TSC. The control unit CU can also change the capacitance of the tunable shunt capacitor TSC.

A situation wherein the main radiator MRAD and the diversity radiator DRAD are simultaneously active is considered in the following. The transmission and reception occurs over LTE band 8 which covers the frequency range from 880 MHz to 960 MHz. Accordingly, the radiators MRAD, DRAD are matched over band 8. To achieve this with the antenna geometry as shown in FIGS. 2A and 2B and the circuit topologies, the inductance of the sensing coils SCOm, SCOd are chosen to be 6 nH for the main sensing coil SCOm and 10 nH for the diversity sensing coil SCOd. The capacitance of the tunable main series capacitor TCAm and of the tunable diversity series capacitor TCAd is set to 5.2 pF for both capacitors. The capacitance of the tunable shunt capacitor TSC is set to 2.5 pF.

As the tunable shunt capacitor TSC has a rather small capacitance in this setting, the reactance and resistance of the corresponding path SP2 will be rather large. Accordingly, the path SP2 will act similar to an open connection. Therefore, the radiator DRAD does not interact with the tunable shunt capacitor TSC and signals do not flow to ground through the capacitor TSC.

During operation in GSM, the diversity radiator DRAD can be utilized as ground plane extension. This is achieved by increasing the value of the tunable shunt capacitor TSC to its maximum value 17.5 pF. The reactance of a capacitor is inversely proportional to the capacitance value with a fixed frequency. The same applies also for the resistance. Thus, increasing the capacitance of the tunable shunt capacitor TSC will correspond to connecting the diversity radiator DRAD to a lower-ohmic impedance connection. As the capacitance of the tunable shunt capacitor TSC is increased, more and more signals penetrate through the tunable shunt capacitor TSC to ground. If the capacitance is set to a maximum value, the diversity radiator DRAD is basically grounded.

The selected component values discussed above do not necessarily present the optimal component values and possibly, several component value combinations could lead to adequate impedance matching over band 8. Also, the selected matching circuit topologies are only examples of several possibilities.

The tuning range of tunable capacitors TCAm, TCAd, TSC is typically assumed to be 1:7. Accordingly, the maximum possible capacitance that is achievable with tolerable losses is seven times the minimum possible capacitance.

Figure 3:
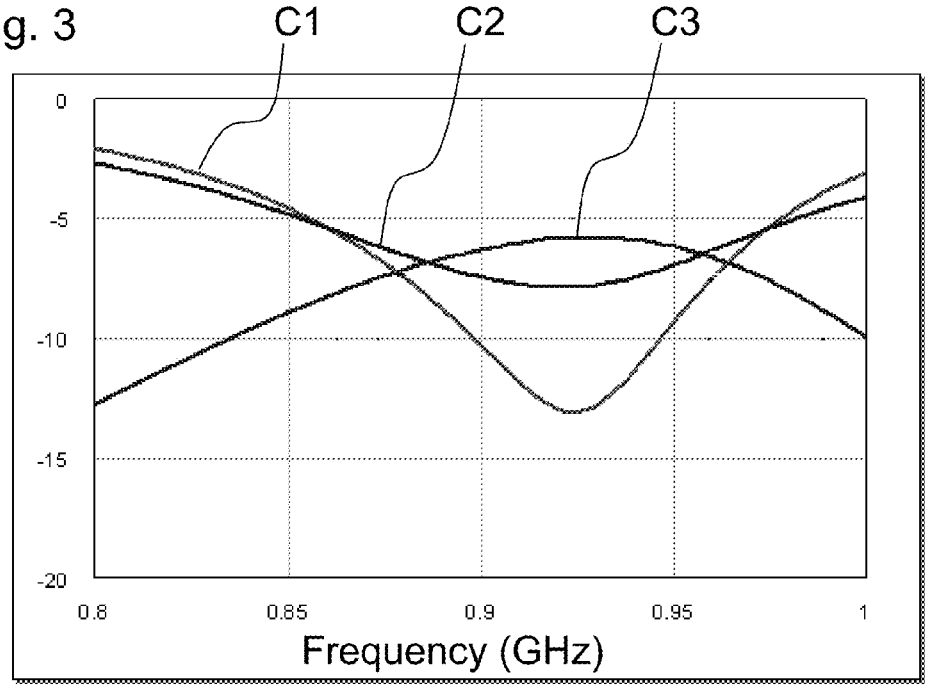
FIG. 3 shows the frequency characteristics of the device when both radiators are simultaneously matched over band 8.

FIG. 3 shows the frequency characteristics of the main radiator MRAD and the diversity radiator DRAD for a configuration as discussed with respect to FIGS. 2A and 2B. The main and the diversity radiator MRAD, DRAD are matched over band 8. Accordingly, both radiators MRAD, DRAD are in use. Curve C1 shows the return loss for the main radiator MRAD. Curve C2 shows the return loss for the diversity radiator DRAD. It can be gathered from FIG. 3 that the return loss is minimal over the frequency band ranging from 880 MHz to 960 MHz. Curve C3 shows the port isolation between the two radiators MRAD, DRAD.

Figure 4:
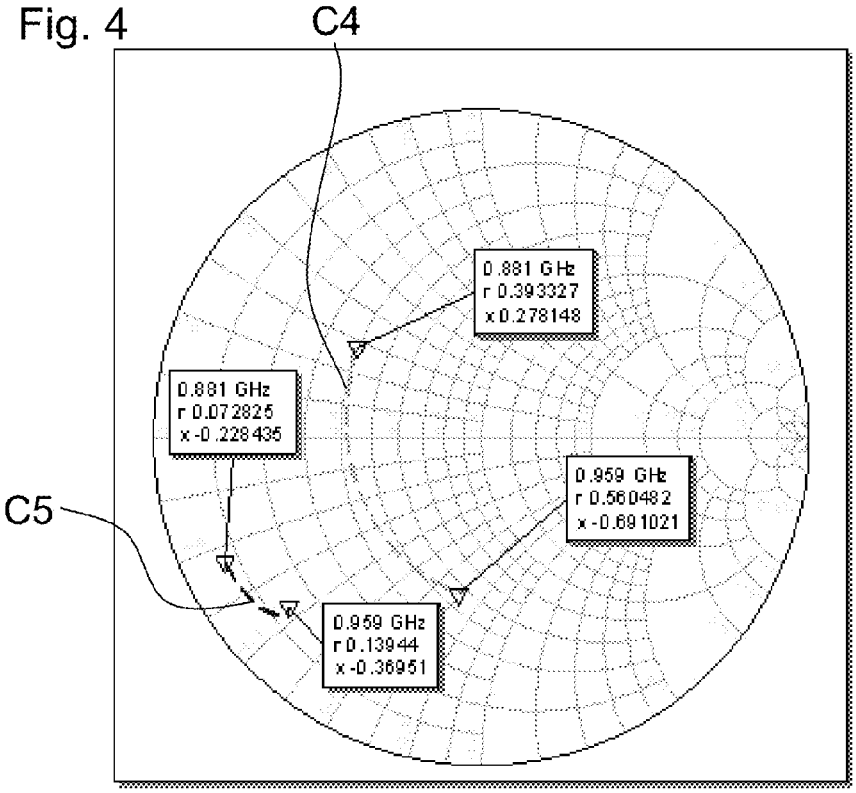
FIG. 4 shows the impedance seen from the diversity radiator feed point towards the diversity RF front-end module for different settings of the tunable shunt capacitor.

FIG. 4 is a Smith-diagram showing the impedance seen from the diversity radiator feed point towards the diversity front-end module DFEM. Curve C4 shows the impedance, if the tunable shunt capacitor TSC is set to a low capacitance of 2.5 pF. This corresponds to an active diversity radiator DRAD. For curve C5, the tunable shunt capacitor TSC is set to 17.5 pF. Accordingly, the diversity radiator DRAD is not in use and is utilized as a ground plane extension. Clearly, the impedance is reduced when the capacitance of the tunable shunt capacitor TSC is increased.

Figure 5:
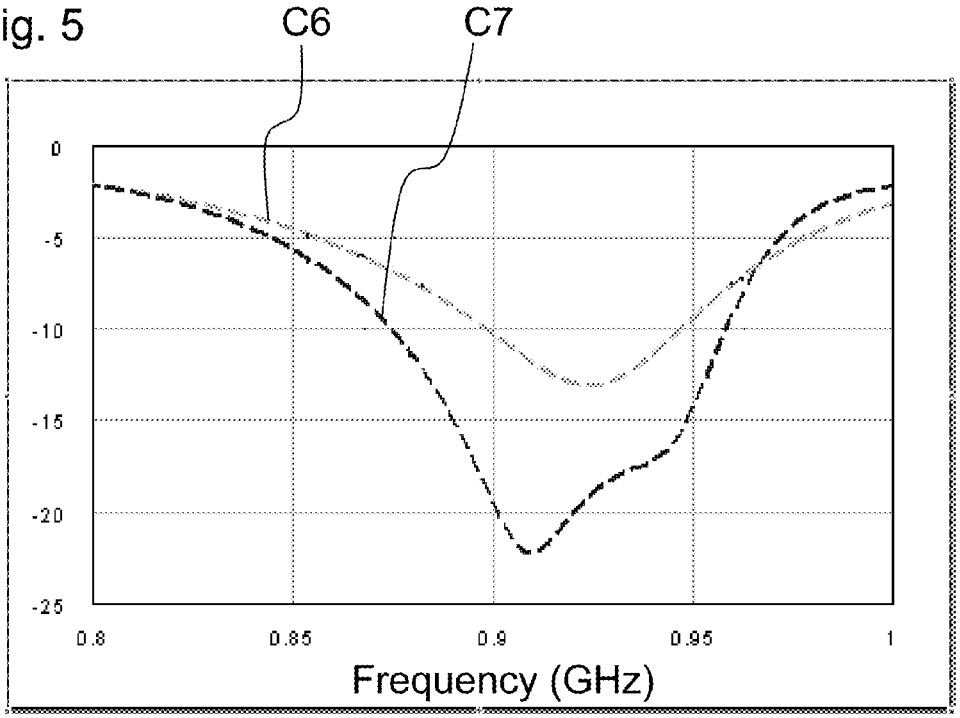
FIG. 5 shows the impedance matching of the active radiator for different settings of the tunable shunt capacitor.

FIG. 5 shows the return loss of the main radiator MRAD. Curve C7 shows the return loss for the main radiator MRAD, wherein the diversity antenna DRAD is inactive and the tunable shunt capacitor TSC is set to the maximum capacitance of 17.5 pF. Curve C6 shows the case of an active diversity antenna DRAD wherein the tunable shunt capacitor TSC is set to a low capacitance of 2.5 pF. This curve is identical to curve C1 of FIG. 3. FIG. 5 clearly shows that the instantaneous impedance bandwidth of the active radiator, defined at −6 dB input reflection coefficient level, has increased approximately 15% corresponding to a bandwidth increase of approximately 14 MHz. In addition to this, the input matching at the center of the band has improved noticeably.

Figure 6:
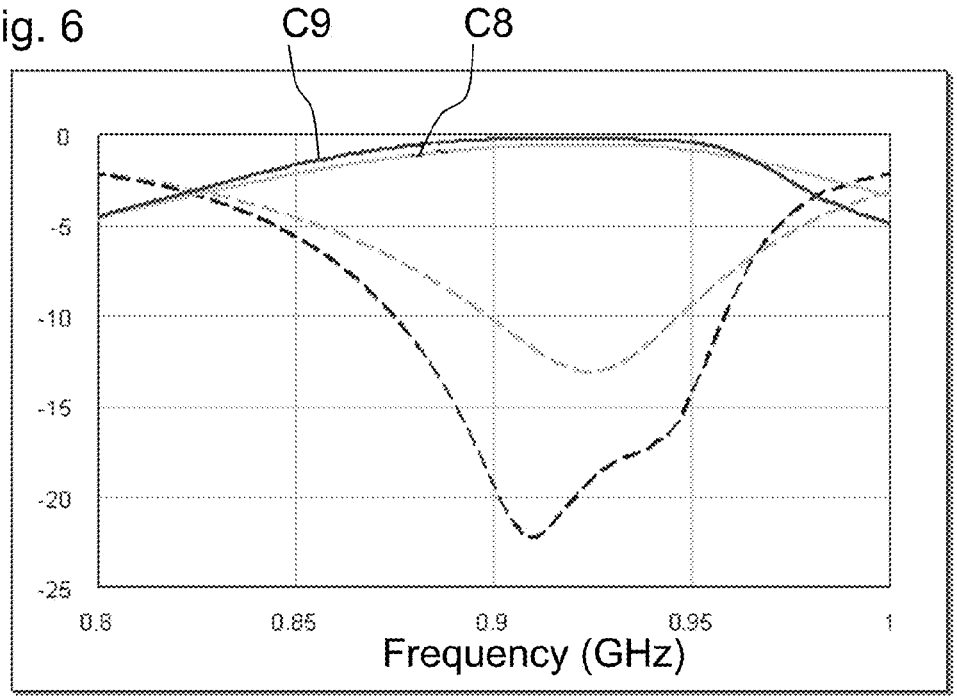
FIG. 6 shows the input matching and matching efficiency of the main radiator.

FIG. 6 shows the matching efficiencies of the configurations with both diversity radiator matching circuit configurations. Curve C8 corresponds to the situation when the tunable shunt capacitor TSC has a low capacitance of 2.5 pF. Curve C9 corresponds to the situation when the tunable shunt capacitor TSC has a maximum capacitance of 17.5 pF. The wider impedance bandwidth obtained with the proposed PWB extension—as shown in Curve C9—maps into approximately 0.5 dB improvement in total efficiency at the lowest edge of band 8 over Curve C8, as simulations predict the same radiation efficiency in both cases corresponding to Curves C8 and C9.

LIST OF REFERENCE SIGNS

MRAD—main radiator
DRAD—diversity radiator
PWB—printed wiring board
BEZ—bezel
MFEM—main front-end module
SPm—main signal path
SCOm—main sensing coil
TCAm—tunable main series capacitor
ESDCm—main ESD coil
CU—control unit
DFEM—diversity front-end module
SPd—diversity signal path
SCOd—diversity sensing coil
TCAd—tunable diversity series capacitor
ESDCd—diversity ESD coil
TSC—tunable shunt capacitor
SP2—path

We claim:

1. A mobile communication device comprising:

a ground plane;

a main antenna comprising a main radiator that can couple electromagnetically to the ground plane and to a first signal path;

a diversity antenna comprising a diversity radiator;

a reconfigurable input matching circuit that couples the diversity radiator to the ground plane and to a second signal path;

a control unit coupled to the reconfigurable input matching circuit and adapted to change the coupling of the diversity radiator to the ground plane during operation, wherein the reconfigurable input matching circuit comprises a tunable capacitor, wherein the diversity radiator is connected to the ground plane via a path that comprises the tunable capacitor, and wherein the capacitance of the tunable capacitor is set to a maximum value when the diversity antenna is inactive.

2. The mobile communication device according to claim 1, wherein the capacitance of the tunable capacitor is set to value below a maximum value when the diversity antenna is active.

3. The mobile communication device according to claim 1, wherein the reconfigurable input matching circuit comprises a second tunable capacitor and a sensing coil.

4. The mobile communication device according to claim 1, further comprising a second reconfigurable input matching circuit, wherein the main radiator is coupled to the first signal path via the second reconfigurable input matching circuit, and wherein the control unit is coupled to the second reconfigurable input matching circuit and adapted to change the coupling of the main radiator to the first signal path during operation.

5. The mobile communication device according to claim 1, wherein the main antenna and the diversity antenna are specified for a LTE communication device.

6. The mobile communication device according to claim 1, wherein the main radiator and the diversity radiator are arranged at opposite ends of the ground plane.

7. The mobile communication device according to claim 1, further comprising a printed wiring board wherein the ground plane, the control unit and the reconfigurable input matching circuit are arranged on the printed wiring board.

8. The mobile communication device according to claim 1, wherein coupling the diversity radiator to the ground plane enhances the performance of the main antenna in a GSM operation mode, in a WCDMA operation mode, or in a LTE TDD operation mode.

9. The mobile communication device according to claim 1, comprising two or more main antennas wherein each main antenna comprises a main radiator.

10. The mobile communication device according to claim 1, comprising two or more diversity antennas wherein each diversity antenna comprises a diversity radiator, each diversity radiator being connected to a reconfigurable input matching circuit that couples the respective diversity radiator to the ground plane and to a diversity signal path, wherein the control unit can change the coupling of each diversity radiator (DRAD) to the ground plane during operation.

11. A method for enhancing the performance of a mobile communication device, wherein the mobile communication device comprises a ground plane, a main antenna comprising a main radiator that can couple electromagnetically to the ground plane and to a first signal path, a diversity antenna comprising a diversity radiator, a reconfigurable input matching circuit that couples the diversity radiator to the ground plane and to a second signal path, and a control unit coupled to the reconfigurable input matching circuit and adapted to change the coupling of the diversity radiator to the ground plane during operation, wherein the control unit reconfigures the reconfigurable input matching circuit during operation of the device to change the coupling of the diversity radiator to the ground plane and to enhance the performance of the main antenna, wherein the reconfigurable input matching circuit comprises a tunable capacitor, wherein the diversity radiator is connected to the ground plane via a path that comprises the tunable capacitor, and wherein the control unit sets the capacitance of the tunable capacitor to a maximum value when the diversity radiator is inactive.

12. The method according to claim 11, wherein during operation of the main antenna with an inactive diversity antenna, the control unit reconfigures the reconfigurable input matching circuit to provide a coupling of the diversity radiator to the ground plane that is lower-ohmic compared to the coupling of the diversity radiator to the second signal path.

13. The method according to claim 11 or 12, wherein during simultaneous operation of the main and the diversity, the control unit reconfigures the reconfigurable input matching circuit to provide a coupling of the diversity radiator to the ground plane that is higher-ohmic compared to the coupling of the diversity radiator to the second signal path.

14. The method according to claim 11, wherein the control unit sets the capacitance of the tunable capacitor to a value below a maximum value when the diversity radiator is active.

15. A mobile communication device comprising:

a ground plane;

a main antenna comprising a main radiator that can couple electromagnetically to the ground plane and to a first signal path;

a diversity antenna comprising a diversity radiator;

a reconfigurable input matching circuit that couples the diversity radiator to the ground plane and to a second signal path; and a control unit coupled to the reconfigurable input matching circuit and adapted to change the coupling of the diversity radiator to the ground plane during operation, wherein, during operation of the main antenna with an inactive diversity antenna, the control unit is configured to reconfigure the reconfigurable input matching circuit to provide a coupling of the diversity radiator to the ground plane that is lower ohmic compared to the coupling of the diversity radiator to the second signal path.

* * * * *